US006390189B1

(12) United States Patent
Tienari et al.

(10) Patent No.: US 6,390,189 B1
(45) Date of Patent: May 21, 2002

(54) FEED APPARATUS FOR FEEDING CAPSULAR CARTRIDGES INTO DRILLED HOLE

(75) Inventors: Ossi Tienari, Kilvakkala; Heikki Jantunen; Tauno Tikkanen, both of Tampere; Olli Jokisalo, Kyröskoski; Vesa Peltonen, Tampere, all of (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 09/605,859

(22) Filed: Jun. 29, 2000

Related U.S. Application Data

(63) Continuation of application No. PCT/FI99/00027, filed on Jan. 18, 1999.

(30) Foreign Application Priority Data

Jan. 20, 1998 (FI) ..... 980118

(51) Int. Cl.[7] ..... E21B 33/00
(52) U.S. Cl. ..... 166/75.15; 166/70
(58) Field of Search ..... 166/70, 75.15, 166/90.1, 69

(56) References Cited

U.S. PATENT DOCUMENTS

| | | | | |
|---|---|---|---|---|
| 2,713,909 A | * | 7/1955 | Baker | |
| 3,104,584 A | | 9/1963 | Jacobs | |
| 4,229,124 A | | 10/1980 | Frey et al. | |
| 5,165,825 A | | 11/1992 | Wallin | |
| 5,188,178 A | * | 2/1993 | Noyes | 166/310 |
| 6,039,122 A | * | 3/2000 | Gonzalez | 166/379 |
| 6,044,905 A | * | 4/2000 | Harrison | 166/75.15 |
| 6,056,058 A | * | 5/2000 | Gonzalez | 166/310 |
| 6,182,752 B1 | * | 2/2001 | Smith et al. | 166/70 |

FOREIGN PATENT DOCUMENTS

| | | |
|---|---|---|
| FI | 33315 | 1/1964 |
| WO | WO-99/36674 A1 * | 7/1999 |
| ZA | 846564 | 8/1984 |

* cited by examiner

*Primary Examiner*—David Bagnell
*Assistant Examiner*—Jennifer R. Dougherty
(74) *Attorney, Agent, or Firm*—Burns, Doane, Swecker & Mathis, L.L.P.

(57) ABSTRACT

The invention relates to a feed apparatus for feeding capsular cartridges into a drilled hole, the apparatus being intended to be used in conjunction with a rock drill apparatus. The feed apparatus comprises a rotatable roll-like cartridge magazine (1) with charge tubes (2) which are arranged on at least one perimeter and into which the capsular cartridges can be loaded in advance. The apparatus further comprises means for indexing a magazine, whereby the desired charge tubes (2) can be rotated to align with the feeding line. In an embodiment of the invention the feed is performed by feeding pressure air into the rear end of the charge tube at a high pressure, whereby the cartridge loaded into the charge tube moves from the charge tube to a connecting pipe (7) positioned at the firing line at the front end of the cartridge magazine and further along a feed hose 86) to a hole drilled in advance. The apparatus can also comprise a control apparatus for automatic control of the feed apparatus from the cabin.

16 Claims, 3 Drawing Sheets

FEED APPARATUS FOR FEEDING CAPSULAR CARTRIDGES INTO DRILLED HOLE

This application is a continuation of International Application No. PCT/FI99/00027, filed on Jan. 18, 1999, which International Application was published by the International Bureau in English on Jul. 22, 1999.

BACKGROUND OF THE INVENTION

The invention relates to a feed apparatus for feeding capsular cartridges into a drilled hole, the apparatus being intended to be arranged in conjunction with a rock drill apparatus and comprising tubular spaces arranged on at least one perimeter of a rotatable cylindrical cartridge magazine, the cartridge to be fed being insertable in the tubular spaces, i.e. charge tubes, and means for feeding pressure air into the rear end of the charge tubes indexed to the feed position so as to convey the cartridges loaded into the charge tubes to the drilled hole by means of pressure air.

In rock drilling, soldered anchor bolts are used to strengthen the rock and to prevent blocks from breaking off. The bolts can be soldered, for example, using cement mass, adhesive or a soldering material comprising two or more components. In practice it is two-component epoxy or polyester-based soldering materials that are used in the soldering, since their curing time can be easily adjusted by changing the quantity or characteristics of the curing agent. Further, such soldering materials provide good support, and they help to prevent the bolt from corroding in the hole. When a two-component soldering material is used, a necessary number of so-called resin cartridges are first arranged in the drill hole, after which an anchor bolt is arranged in the hole. If the resin cartridges have not yet been broken, the bolt breaks the cartridges, whereby the soldering material contained in the cartridges mixes with the curing agent, and the soldering material starts to cure. The soldering of the resin cartridges thus comprises three steps: drilling of a hole, feeding of the cartridges into the hole, and insertion of a bolt into the hole.

At present the resin cartridges are introduced into the drilled holes either manually or by firing them individually into the drilled hole by means of pressure air. Since the drilling is otherwise performed mechanically and is highly automated, manual introduction of the cartridges is not sensible: it is much too slow and may jeopardize occupational safety. Because of this, one has developed an apparatus which is operated by pressure air and by which the cartridges can be shot individually from the cabin of the drill apparatus to the drilled hole. The cartridges are loaded individually into a cartridge chamber, from which they are pushed by pressure air to a feed hose and along the hose to a nozzle located at the outermost end of the hose. The tip of the nozzle is aligned with the drilled hole so that when a cartridge is shot, it penetrates into the hole without any difficulty. The resin cartridge is a tubular element closed at its both ends. The case of the element is usually made of tubular plastic film, and a soldering material is extruded inside the element. A curing agent is arranged within the case separately, after which the ends of the cartridge are closed. When such a cartridge is shot to a hole at a high rate, it usually breaks in the hole so that the curing agent and the actual soldering material mix and the curing starts. It is, however, rather laborious and slow to use this kind of apparatus, for the cartridges are here loaded and shot manually one by one. Sometimes in the case of long anchor bolts or bolts with otherwise special demands it may be necessary to fire several resin cartridges into one and the same hole, naturally depending on the size of the resin cartridges. It takes rather a long time to feed so many cartridges by an apparatus that fires cartridges individually, and so a long curing time for resin is needed. Further, since the principle of operation makes it necessary to place the apparatus in the control cabin of the rock drill apparatus, the user risks being exposed to harmful gases expelled from leaking or breaking cartridges. On the plea of occupational safety, many countries have therefore prohibited the handling of cartridges in a closed space. Another drawback of the apparatus is that space must be reserved for storing cartridges in an even otherwise confined cabin so that the cartridges will be close at hand when they need to be shot.

The object of the invention is to provide a better and more efficient feed apparatus for pneumatic feeding of capsular cartridges into a drilled hole.

The feed apparatus of the invention is characterized in that the feed apparatus comprises a rotating apparatus to turn the cartridge magazine about its longitudinal axis to a predefined position so that at least one tubular space is in the feed position, i.e. aligns with a feed hose leading to the drilled hole, and that the feed apparatus comprises sealing means for sealing the front and rear ends of the charge tube indexed to the feed position.

The essential idea of the invention is that the feed apparatus comprises a rotatable roll-like cartridge magazine that comprises tubular spaces on one or more of its perimeters, the cartridges being loaded into these spaces before the pneumatic feed, i.e. the 'shot'. To fire a cartridge, the tubular space that contains the cartridge to be fed at a given moment is indexed to the feed position by the magazine-rotating apparatus, after which the contents of the tube is fed along the feed hose into the drill hole by means of pressure air. The essential idea of a preferred embodiment of the invention is that the cartridge magazine comprises separate charge tubes that are open at their both ends. The essential idea of a second preferred embodiment is that charge tubes are arranged on at least two coaxial perimeters. The idea of a third preferred embodiment is that the cartridge magazine is arranged vertically, so that gravitation can be used to help to move the cartridges.

The advantage of the invention is that the cartridges can be fed automatically without touching them by hand. There is less need to handle the cartridges, and so the occupational safety is improved. In addition, the cartridges need not be handled at all in the control cabin, for the cartridges are loaded into the magazine outside the cabin, and the actual firing has been automated. No fumes are expelled from the resin cartridges or the like to the cabin at any point, and no space needs to be reserved for the handling or storage of the cartridges. It is also clear that the automated firing is much quicker and more efficient than individual firing of the cartridges, not to mention manual loading. With the apparatus of the invention, the contents of a charge tube can be shot in about 2 or 3 seconds. When charge tubes are arranged on more than one perimeter, the capacity of the magazine is naturally higher. Further, there is always more than one charge tube ready in the feed position for the firing, whereby several cartridges can be shot, if desired, by a single indexing action, i.e. turning of the cartridge magazine to a predefined position. The time needed for the indexing is thus shorter. The control system of the apparatus according to the invention also allows varied and flexible firing of the cartridges, so that exactly the correct number of desired cartridges can be shot automatically to each hole. The feed apparatus of the invention is particularly well suited for use in conjunction with a bolting device in which a rock drill, a feed device for a soldering material and a feed device for bolts are arranged in the bolting device so that they can be indexed, whereby the bolting steps can be carried out in quick succession.

BRIEF DESCRIPTION OF THE DRAWINGS

The invention is described in greater detail in the attached drawings, in which.

DETAILED DESCRIPTION

Figure 1:
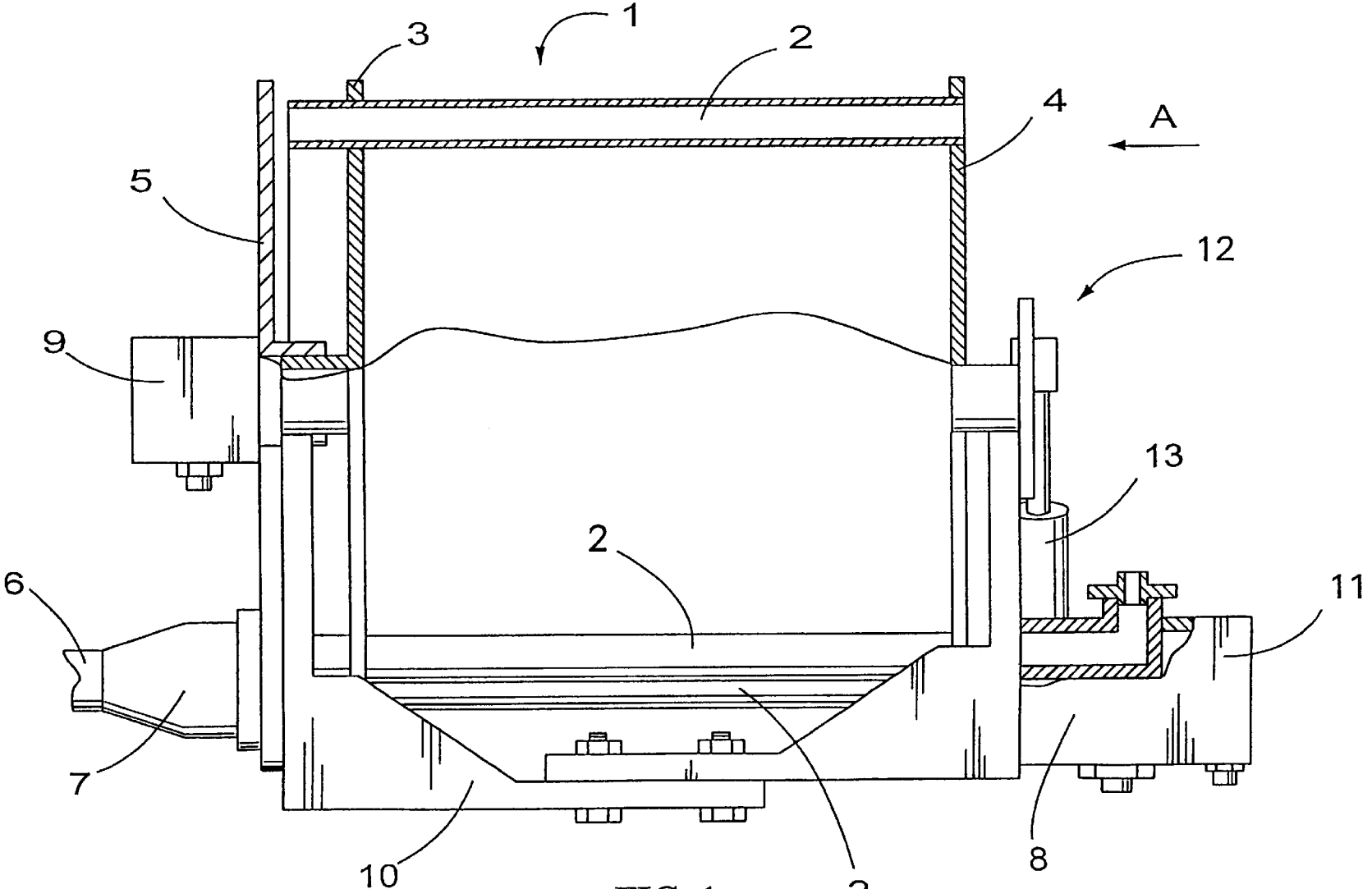
FIG. 1 is a schematic partly sectional side view of a feed apparatus according to the invention.

FIG. 1 shows a simplified side view of a feed apparatus according to the invention. The apparatus comprises a roll-like cartridge magazine 1 that is arranged to rotate, the magazine comprising tubular spaces, i.e. charge tubes 2, which are arranged on two different perimeters at a desired distance from the longitudinal axis and into which the resin cartridges or other such capsules to be shot can be loaded. For the sake of clarity, the figure shows only some of the tubes arranged on the perimeter of the magazine. As appears from FIG. 2 below, the magazine comprises 24 charge tubes on each perimeter, i.e. 48 charge tubes in all, which normally suffices for about half a shift. The feed apparatus thus has to be loaded only twice during a shift. The number of charge tubes is adjusted according to the need. Sometimes it is sufficient to have charge tubes only on one perimeter. If there are tubes on more than one perimeter, the same number of tubes can be arranged in a roll with a smaller diameter. When the cartridge magazine comprises separate charge tubes, the structure is lighter, and it is quicker and easier to manufacture than a magazine manufactured from a solid material by machining. Also, the charge tubes can here be changed, if necessary. A module structure is here provided in which the tube design can be varied to produce firing apparatuses for various purposes. If the tube length is, for example, 1000 mm, three normal 300-mm cartridges can be loaded into the tube and shot at one go. The charge tubes 2 are supported on a foremost end plate 3 at the front of the magazine, and on a rearmost end plate 4 at the back. Apertures are provided on the end plates, on perimeters with a desired radius, and the charge tubes 2 are arranged in these apertures. The charge tubes 2 can be attached to the rearmost end plate 4 and allowed to be loose in respect of the foremost end plate 3, whereby the charge tubes 'float', i.e. they tend to centre on the sealing elements in the feed position. Further, a frame plate 5 is immovably arranged at the front of the cartridge magazine, and apertures joining the charge tubes in the firing position are provided in the plate. Means for sealing the front of the cartridge magazine are also arranged in conjunction with the apertures, the means sealing the section between the frame plate and the charge tubes in the firing position. The sealing arrangement of the front end of the cartridge magazine is described in greater detail in FIG. 4 below. On the opposite side of the frame plate is arranged a connecting pipe 7, which is pressure-tightly connected to a feed hose 6. The feed hose can be a hydraulic hose or some other type of hose that endures the conditions concerned and is preferably slippery on the inside; such a hose would be, for example, a water hose. When a hydraulic hose or the like is used, the firing apparatus can be provided with means for spraying lubricating oil, whereby the friction on the inside of the hose can be reduced. Further, on the outermost end of the feed hose is arranged a nozzle, which is preferably made of tempered steal or the like, the nozzle being conical and thereby fitting well into the drilled hole. The apparatus further comprises a feed block 8, by which a high pressure can be fed from a pneumatic duct to the back of the charge tube, which is in the feed position at the connecting pipe 7, so that the pressure pulse pushes the cartridge forward. The number of pressure feeds comprised by the feed block 8 is the same as the number of charge tubes that can be simultaneously positioned on the firing line. When there are two perimeters in the magazine, the feed block comprises two pressure feeds, whereby it is possible to discharge either the two charge tubes essentially in succession or the two charge tubes separately. When the cartridges are shot in succession to the same hole, there is at least a short delay between the shots, so that the cartridges do not collide in the connecting pipe. A control system can control the firing such that the first cartridge is discharged from the charge tube at a lower pressure, so that it will wait for the next shot in the feed hose. The next cartridge is then discharged from its charge tube at a short delay after the first cartridge at full pressure, whereby the two cartridges are conveyed to the drilled hole. To ensure a sufficient pressure pulse, the pneumatic duct can comprise a pneumatic accumulator or the like before a feed valve. The pressure used is usually of the order 2 to 7 bar. The cartridge-conveying speed is largely determined by the pressure used and the diameter of the feed hose. Further, a sufficiently high pressure breaks the cartridges containing the soldering material, and the curing will start immediately as the cartridges hit the drilled hole at a high rate. It is also pointed out that in the present application the term 'pressure air' is also considered to refer to other pressurized gases than air that can be used for the same purpose; these gases include, for example, carbondioxide, nitrogen, etc.

The feed apparatus further comprises means for moving the cartridge magazine in the axial direction from the firing position to the loading position, and means for indexing the magazine, i.e. turning it about the longitudinal axis so as to align the desired charge tube with the firing line to make it ready for firing. The cartridge magazine can be moved by a first cylinder 9 rearward of an immovably arranged frame 10 and frame plate 5, and by a second cylinder 11 forward in direction A. The magazine can naturally also be moved in the axial direction by a double-acting cylinder, whereby only one cylinder is needed.

Pushed to the foremost position, the charge tubes in the feed position of the magazine press substantially pressure-tightly against the frame plate 5 or seals and/or a sealing cone arranged in conjunction with the plate. Further, the front end of the charge tubes can be sealed such that the ends of the charge tubes are arranged in the end plate 3 at the same level as the end plate, and seal rings are provided in the frame plate 5 or alternatively at the ends of the connecting pipe 7. The charge tube or tubes are here arranged to press against the seals. During the firing, the friction of the seals, the sealing cone or a particular locating pin prevent the magazine from rotating. The magazine can also be locked to the foremost position by a locking element arranged in conjunction with the feed block 8. Pushed in the rearmost position, the magazine can be rotated by a rotating apparatus or, when the rotating apparatus has been switched off, manually. In the rearmost position the sealing mechanism does not prevent the rotation of the magazine when new charge tubes are indexed to the feed position or the magazine is turned to a position suitable for loading. Also, the feed block 8 is sealed to the rear end of the charge tubes such that it does not hamper the rotation of the magazine in the loading position. To load the magazine, the cartridges are inserted from the back into the charge tubes, which are open at the back. The figure also shows a rotating apparatus 12 for the cartridge magazine, the apparatus comprising a swing cylinder 13 and a rotating mechanism by which the force of the swing cylinder 13 is transmitted to the magazine. It is also pointed out that like reference numbers in FIGS. 2 to 5 indicate like members as in FIG. 1.

Figure 2:
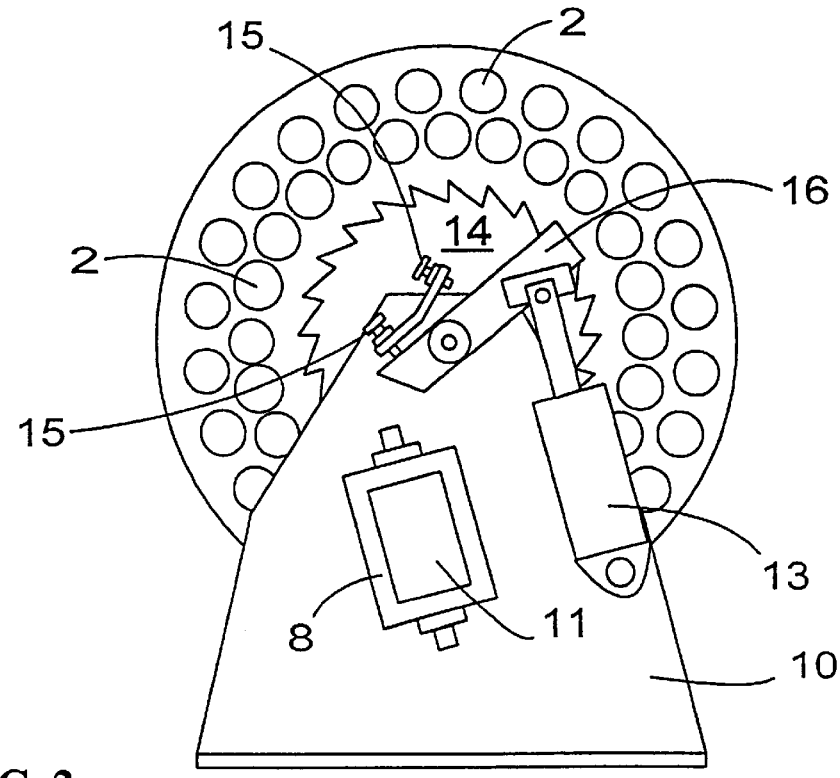
FIG. 2 is a schematic back view of the feed apparatus of FIG. 1 seen from direction A.

FIG. 2 shows the feed apparatus of FIG. 1 from the rear end of the cartridge magazine, i.e. from direction A. As appears from the figure, the apertures of the charge tubes 2 are clearly visible at the back of the magazine to enable loading. In the embodiment of the figure the magazine-rotating mechanism comprises a ratchet wheel system 14 operating on the ratchet principle, the system being driven by a hydraulic or pneumatic swing cylinder 13 and an arm 16 connected thereto. The arm 16 is arranged pivotably, and at one end of the arm there is a connecting part corresponding to the ratchet wheel. The swing of the arm 16 can be adjusted by stoppers 15 so that the next few charge tubes can be indexed accurately to the firing line by one working motion of the swing cylinder. The magazine is thus indexed stepwise. As mentioned above in the description of FIG. 1, the magazine is indexed when it is in the rearmost position, whereby the sealing mechanism or locating means of the front end do not prevent the magazine from being rotated. In the rearmost, i.e. loading, position, either the magazine can be rotated normally by the swing cylinder, simultaneously indexing it, or the rotating apparatus can be switched off, whereby the magazine can be rotated manually during the loading. As shown in FIGS. 1 and 2, the feed block 8 is preferably arranged in conjunction with the second cylinder 11, whereby it is pressure-tightly sealed against the charge tubes in the feeding position when the cylinder 11 pushes the magazine to the foremost position. When the cylinder 11 is not pressurised, the sealing of the feed block does not in any way hamper the rotation of the magazine.

Figure 3:
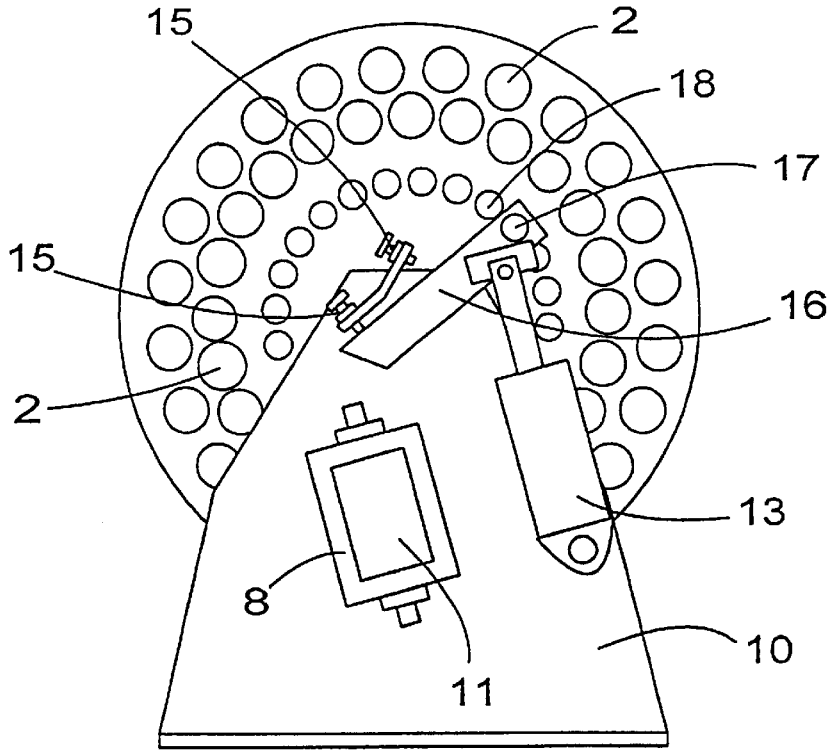
FIG. 3 is a schematic back view of another feed apparatus according to the invention.

FIG. 3 shows another rotating apparatus for the cartridge magazine, seen from the rear end of the magazine. Like the apparatus of the above figure, this rotating apparatus also comprises a swing cylinder 13 and an arm 16, with associated stoppers 15, arranged pivotably in a frame 10. A pin 17 is arranged at the outermost end of the arm 16, and apertures 18 are provided on a suitable perimeter in the rearmost end plate 4 of the cartridge magazine so that the pin fits into the apertures. When the magazine is pushed to the rearmost position, the pin 17 is inserted into the aperture 18, and the swing cylinder 13 can index the magazine. When the magazine is pushed by the cylinder 11 to the foremost position, the pin 17 appears from the aperture 18, and the swing cylinder 13 can move to the basic position for the next swing. When the pin 17 is disengaged, the magazine can be rotated freely in the rearmost position, for example manually.

Figure 4:
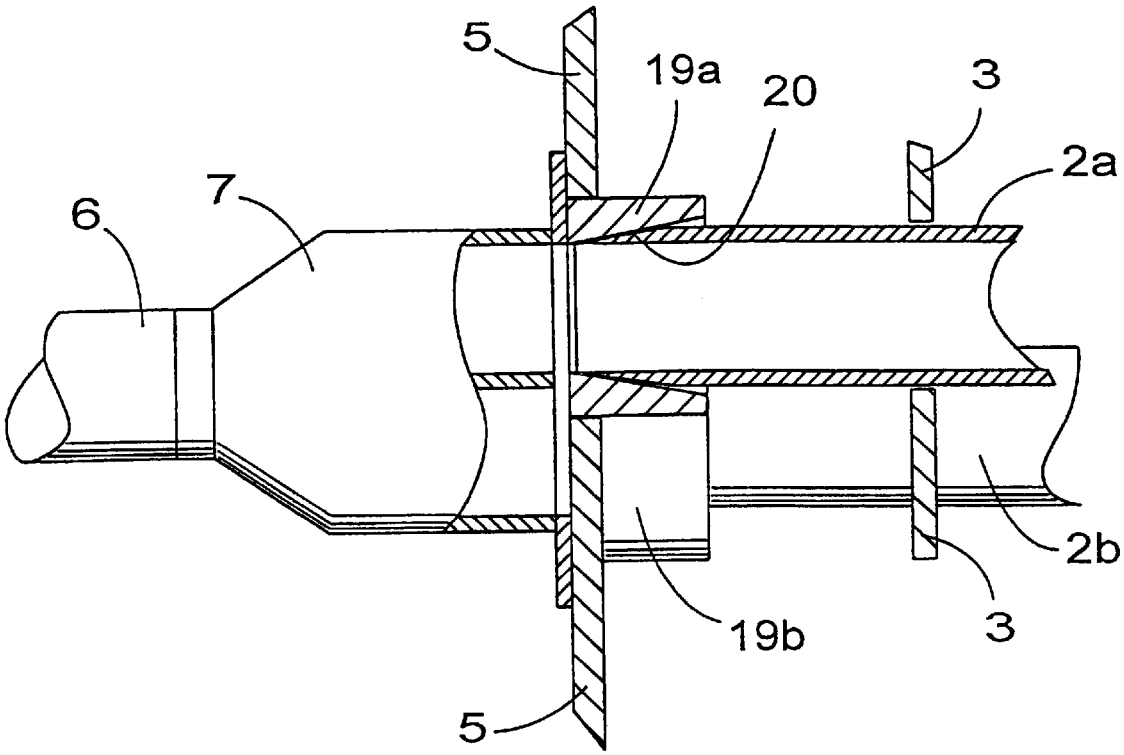
FIG. 4 is a schematic partly sectional view of a sealing arrangement at the front end of a feed apparatus according to the invention.

FIG. 4 shows a more detailed arrangement for sealing the front end of the feed apparatus. In the figure, sealing cones 19*a* and 19*b* are arranged either in the frame plate 5 or alternatively in the connecting pipe 7. At the end of the charge tubes 2*a* and 2*b* is provided an outer cone corresponding to the sealing cones 19*a* and 19*b*, so that when the charge tubes are in the foremost position ready to be fired, the cone surfaces are tightly against each other, and no other sealing is needed. The advantage of this kind of sealing arrangement is that it resists wear. Further, the cone surfaces centre the charge tubes on exactly the correct position of the feeding line. Also, in order that the magazine might be rotated, the sealing cones and/or charge tubes must be moveable in respect of each other in the axial direction of the magazine at least to such an extent that the cones are no longer within each other and can therefore turn past each other. For the sake of clarity, charge tube 2*b* is not shown as a sectional view in the figure, since it is further back than tube 2*a*. Further, the sealing between the charge tubes and the feed block can be based on the cone surfaces or it can comprise an O ring or some other elastic seal.

Figure 5:
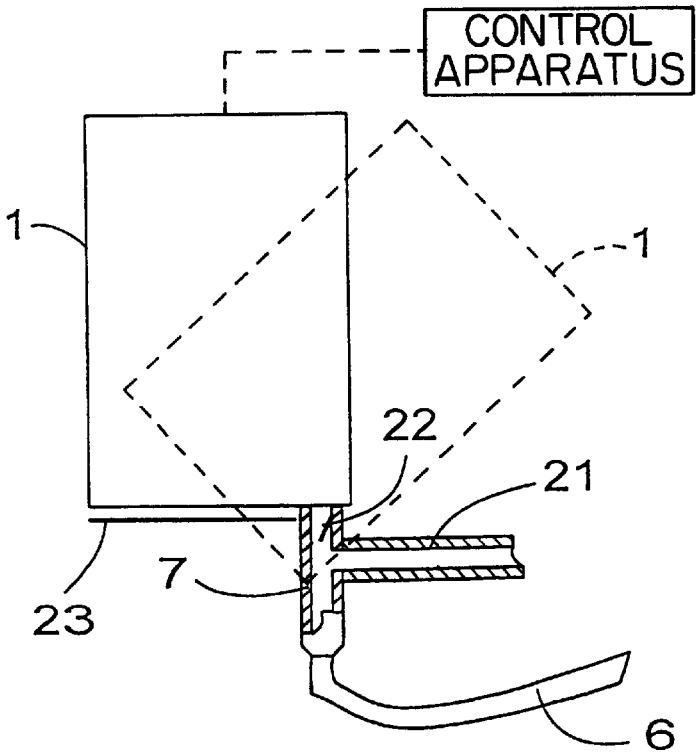
FIG. 5 is a schematic partly sectional side view of a feed apparatus according to the invention arranged vertically.

FIG. 5 shows a simplified view of a feed apparatus according to the invention. The cartridge magazine 1 is here arranged vertically, whereby the cartridges can be loaded from the charge tubes of the magazine to the connecting pipe 7 utilizing gravitation. A flange 23 or some other stop surface can be arranged against the front end of the cartridge magazine to keep the cartridges arranged in the charge tubes inside the magazine. The cartridges are now 'dropped' from the tubular spaces of the magazine through apertures formed in the flange at the feed position to the connecting pipe, when the magazine is rotated in relation to the flange and the connecting pipe. For the sake of clarity, the figure does not show the magazine-rotating apparatus nor the frame structure. When the cartridge has dropped into the connecting pipe 7, pressure air is fed from a connecting pipe 21 behind the cartridge, whereby the pressure moves the cartridge forward in the feed hose 6. To produce the necessary pressure, the upper end of the connecting pipe 7 is sealed for example with a shutter 22 shown in the figure to be essentially pressure-tight. The shutter is automatically closed when pressure is supplied from the connecting pipe 21. It is also possible to arrange a slide or some other closing mechanism between the cartridge magazine and the connecting pipe. In cartridge magazines arranged vertically, the charge tubes in the firing position can be sealed in the same way as in the horizontally arranged magazines, and the necessary pressure air can be fed from the rear end of the charge tubes. However, re-indexing is then not possible until the cartridge has been fed into the drill hole, and so the arrangement is slower than an arrangement in which the upper end of the connecting pipe is sealed independently of the magazine and the pressure is supplied from a separate connecting pipe. On the other hand, when a slide-type sealing arrangement, for example, is used, the contents of the charge tubes of the magazine need not be fed in order; the sealing does not restrict the feed in any way. Further, at least where a single-perimeter magazine is concerned a separate connecting pipe is not needed, but a feed hose can be arranged, for example, directly in conjunction with shutters. The advantage of a magazine arranged vertically is that it is particularly easy to load, and in some situations it is more economic than a horizontal magazine in respect of space.

The feed apparatus of the invention further comprises a control apparatus (shown schematically in FIG. 5) that controls the cycle of the feed apparatus once the user has selected the type and number of cartridges to be fired into the hole concerned at a given moment. The control apparatus thus controls the indexing and the actual firing automatically. The control apparatus can be, for example, a computer, programmable logic or some other suitable, preferably electrical control means. Further, the apparatus can comprise detectors and calculators that give the user information for example on the cartridges available. To detect a malfunction, a sensor can also be arranged in conjunction with the firing line to ensure that there really is a cartridge in the charge tube from which a cartridge is to be fired, so that an empty charge tube will not be fired in any situation.

The drawings and the accompanying description are only intended to illustrate the idea of the invention. The invention can vary in its details within the scope of the claims. Although the specification deals with the feed of resin cartridges only, the apparatus of the invention is equally well applicable to the feeding of other kinds of cartridges. The only condition is that the cartridge to be fed is a capsule with a predefined diameter, and that the capsule can be positioned in the magazine of the firing apparatus of the invention and fired along a hose into a hole by means of pressure air. Examples for such other cartridges are explosive cartridges, adhesive and other soldering cartridges, etc. It is also possible to load cartridges for different purposes into different charge tubes of the cartridge magazine, whereby the control system of the apparatus controls that a desired number of a desired type of cartridges selected by the user are fired into the drilled hole. A magazine can thus simultaneously contain resin cartridges with different curing times, various types of soldering cartridges, and explosive cartridges. If the apparatus of the invention is used to feed explosive cartridges, it is advantageous to safety to use explosives de-excited with radio waves, so that no detonating wires or other such conductors are needed to de-excite the explosives. If several explosive cartridges are fed into one and the same hole, it is sufficient that one cartridge, for example the first or the last one, comprises a detonator and that this cartridge is fired by itself preferably in a controlled manner.

Further, the cartridge magazine can also be rotated and aligned with the desired firing position in many different ways. The magazine can be rotated, for example, steplessly by an electric motor, and it can be aligned and the different charge tubes identified by various electrical sensors and detectors. Special attention, however, must then be paid to the ability of the components to endure different conditions, and to the protection of the components. Further, a horizontal magazine need not necessarily be moveable in the axial direction, but it can also be sealed in another way, for example by moving the frame and/or frame plate, including the seals, in respect of the magazine. In addition, the first cylinder can be arranged at the feeding line in the same way as the second cylinder and be arranged to move the seal of the front end moveable in the axial direction. The front end can be sealed, for example, at that end of the connecting pipe that leads to the magazine, and the cylinder of the front end can be arranged to move the connecting pipe. Further, it is possible to load the cartridge magazine automatically, for example, by a suitable manipulator. A magazine can comprise charge tubes with different inner diameters, whereby it is possible to fire cartridges with different diameters. The diameter of the largest cartridge is naturally at most equal to the inner diameter of the feed hose, and preferably slightly smaller. A separate pusher can be arranged at the rear end of any smaller cartridges to ensure that the cartridge will be conveyed in a feed pipe with a larger diameter. Further, although the figure shows the extreme positions of the cartridge magazine, i.e. the vertical and the horizontal positions, the magazine can also be arranged at a suitable angle (an inclined magazine 1 is shown in phantom in FIG. 5). The horizontal position and the vertical position are here separated by an angle of 45°. To convey the cartridge to the feed hose, it is advantageous if the magazine has an inclination of for example 10° to 30°. This kind of magazine is thus here horizontal.

What is claimed is:

1. A feed apparatus for feeding capsular cartridges into a drilled hole, the apparatus being intended to be arranged in conjunction with a rock drill apparatus and comprising:

a rotatable cylindrical cartridge magazine having a plurality of charge tubes in the form of tubular spaces arranged around the magazine, a cartridge to be fed being insertable in the charge tubes means for feeding pressurized air into a rear end of at least one of the charge tubes, when the at least one of the charge tubes is indexed to a feed position, so as to convey a cartridge loaded into the at least one of the charge tubes to the drilled hole;

a rotating apparatus arranged to turn the magazine about a longitudinal axis of the magazine to a position so that the at least one tubular space is in the feed position; and seals for sealing a front end and the rear end of the at least one of the charge tubes indexed to the feed position.

2. The feed apparatus as claimed in claim 1, wherein the charge tubes are separate, are arranged on at least one radius from the longitudinal axis, and are open at their front and rear ends.

3. The feed apparatus as claimed in claim 1, wherein the magazine includes charge tubes disposed on at least two coaxial circles.

4. The feed apparatus as claimed in claim 3, further comprising a connecting pipe at with least one aperture arranged to correspond to each charge tube of the at least one charge tube indexed to the feed position, one end of the connecting pipe being connected to an end of a feed hose, and wherein a single indexing action of the magazine permits cartridges to be fed from a plurality of charge tubes.

5. The feed apparatus as claimed in claim 1 further comprising means for changing relative positions of the magazine and the seals by an axial movement between them such that rotation of the magazine is not hampered by the seals during indexing and the loading.

6. The feed apparatus as claimed in claim 5, wherein the magazine is adapted to be moved in an axial direction in relation to the seals sealing the front end.

7. The feed apparatus as claimed in claim 6, wherein the apparatus comprises a cylinder for moving the magazine to an axially rearmost position and a second cylinder for moving the magazine to an axially foremost position, and wherein, when the magazine is in the axially foremost position, charge tubes are arranged to press against the seals at the front end and, when the magazine is in the axially rearmost position, the magazine is free to turn in relation to the seals at the front end.

8. The feed apparatus as claimed in claim 7, wherein the second cylinder is disposed by the at least one charge tube in the feed position, and a feed block is arranged in conjunction with the cylinder so that when the second cylinder pushes the magazine axially forward, feed block seals are arranged to seal against a rear end of the at least one charge tube in the feed position, and when the second cylinder has returned to the axially rearmost position, the feed block seal is adapted to yield.

9. The feed apparatus as claimed in claim 1, wherein the magazine is arranged horizontally.

10. The feed apparatus as claimed in claim 9, wherein the magazine is inclined at an angle of 10° to 30° so that the front end is lower than the rear end.

11. The feed apparatus as claimed in claim 1, wherein the magazine is arranged vertically.

12. The feed apparatus as claimed in claim 11, wherein the feed apparatus comprises a stop surface arranged against the front end of the magazine, the stop surface including at least one aperture corresponding to the at least one charge tube in the feed position to allow cartridges to pass through the stop surface.

13. The feed apparatus as claimed in claim 1, wherein the rotating apparatus comprises a swing cylinder arranged to turn the magazine.

14. The feed apparatus as claimed in claim 1, wherein the rotating apparatus comprises a swing cylinder, an arm and a pin.

15. The feed apparatus as claimed in claim 1, wherein a length of the charge tubes is such that a plurality of cartridges can be arranged in each charge tube one after the other, and wherein the apparatus is adapted to discharge a plurality of cartridges from one and the same tube in succession.

16. The feed apparatus as claimed in claim 1, comprising a control apparatus arranged to control the motion of the feed apparatus automatically and to feed a number of desired cartridges into the drilled hole.

* * * * *